US012735777B2

(12) United States Patent
Akada et al.

(10) Patent No.: US 12,735,777 B2
(45) Date of Patent: Sep. 15, 2026

(54) STEEL WIRE AND METHOD OF MANUFACTURING STEEL WIRE

(71) Applicant: Sumitomo Electric Industries, Ltd., Osaka (JP)

(72) Inventors: Takumi Akada, Osaka (JP); Kei Hirai, Osaka (JP); Tetsuya Nakajima, Osaka (JP); Akifumi Matsuoka, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 18/873,479

(22) PCT Filed: Jul. 3, 2023

(86) PCT No.: PCT/JP2023/024538
§ 371 (c)(1),
(2) Date: Dec. 10, 2024

(87) PCT Pub. No.: WO2024/024401
PCT Pub. Date: Feb. 1, 2024

(65) Prior Publication Data

US 2025/0320589 A1 Oct. 16, 2025

(30) Foreign Application Priority Data

Jul. 29, 2022 (JP) ..... 2022-121882

(51) Int. Cl.
*C22C 38/18* (2006.01)
*B21C 1/02* (2006.01)
(Continued)

(52) U.S. Cl.
CPC ..... *C22C 38/18* (2013.01); *B21C 1/02* (2013.01); *C21D 8/06* (2013.01); *C22C 38/02* (2013.01); *C22C 38/04* (2013.01)

(58) Field of Classification Search
None
See application file for complete search history.

(56) References Cited

U.S. PATENT DOCUMENTS 5,248,353 A 9/1993 Nishida et al.
6,715,331 B1 * 4/2004 Zelin ..... B21C 1/04 72/286
(Continued)

FOREIGN PATENT DOCUMENTS

JP H02263951 A 10/1990
JP H06158224 A 6/1994
(Continued)

*Primary Examiner* — Daniel J. Schleis
(74) *Attorney, Agent, or Firm* — Volpe Koenig

(57) ABSTRACT

This steel wire comprises a steel containing 0.9-1.1 mass % of carbon, 0.15-0.25 mass % of silicon, 0.25-0.35 mass % of manganese, and 0.15-0.25 mass % of chromium, with the remainder consisting of iron and unavoidable impurities, wherein: the steel has a ferrite structure; the diameter of the steel wire is 0.05-0.45 mm; the tensile strength of the steel wire is 3900 to 4700 MPa, in the longitudinal cross section of the steel wire; and the surface region from the surface of the steel wire to a depth of 10% of the diameter has a structure in which the total ratio A of the <100> azimuth aggregate structure ratio $A_{100}$, the <110> azimuth aggregate structure ratio $A_{110}$, and the <111> azimuth aggregate structure ratio $A_{111}$ is 32% or less.

12 Claims, 1 Drawing Sheet

(51) Int. Cl.

| | |
|---|---|
| ***C21D 8/06*** | (2006.01) |
| ***C22C 38/02*** | (2006.01) |
| ***C22C 38/04*** | (2006.01) |

(56) References Cited

U.S. PATENT DOCUMENTS

| | | | | |
|---|---|---|---|---|
| 2011/0168302 | A1 | 7/2011 | Takahashi et al. | |
| 2014/0241000 | A1 | 8/2014 | Matsumoto | |
| 2015/0301297 | A1 | 10/2015 | Kosaka et al. | |
| 2017/0241000 | A1* | 8/2017 | Daito | C22C 38/02 |
| 2020/0048731 | A1* | 2/2020 | Manabe | C21D 9/525 |

FOREIGN PATENT DOCUMENTS

| | | | |
|---|---|---|---|
| JP | 2017186633 | A | 10/2017 |
| JP | 2022056005 | A | 4/2022 |
| WO | 2010150450 | A1 | 12/2010 |
| WO | 2014054756 | A1 | 4/2014 |
| WO | 2016024635 | A1 | 2/2016 |

* cited by examiner

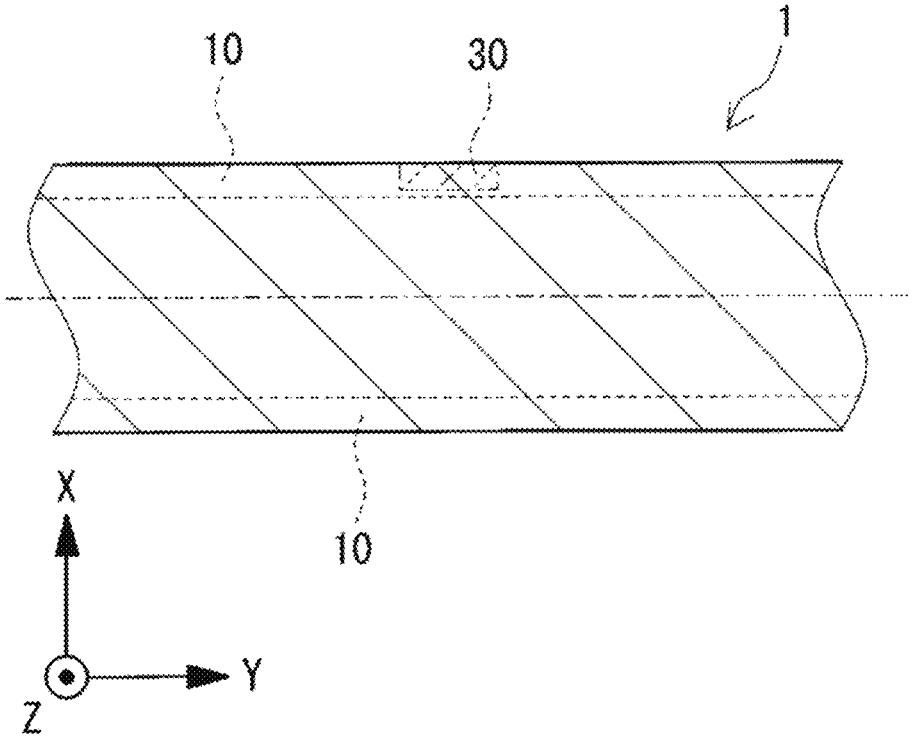
10
30
1
10
X
Y
Z

STEEL WIRE AND METHOD OF MANUFACTURING STEEL WIRE

TECHNICAL FIELD

The present disclosure relates to a steel wire and a method of manufacturing a steel wire. This application claims priority to Japanese Patent Application No. 2022-121882, filed on Jul. 29, 2022, the entire contents of which are hereby incorporated herein by reference.

BACKGROUND ART

Patent Literature 1 discloses a steel wire having a wire diameter of 0.05 mm to 0.38 mm and a tensile strength of 3300 MPa to 3900 MPa. Such a steel wire is used, for example, as a reinforcing member for tires. Patent Literature 1 describes a method of manufacturing the steel wire, and the method is as follows. A steel wire rod that is used as a material is prepared. The steel wire rod is heated by hot drawing to be austenitized and is subsequently cooled to be pearlitized. The pearlitized steel wire rod is further subjected to a drawing process and a patenting process, which are performed in combination. Accordingly, the steel wire rod is processed to have a predetermined wire diameter. The steel wire rod having the predetermined wire diameter is subjected to a final patenting process. Next, the steel wire rod is subjected to a first drawing process. The drawn product resulting from the first drawing process is subjected to a swaging process. The intermediate drawn product resulting from the swaging process is subjected to a second drawing process. With this method, the steel wire is obtained.

CITATION LIST

Patent Literature

PTL 1: Japanese Unexamined Patent Application Publication No. 2017-186633

SUMMARY OF INVENTION

A steel wire of the present disclosure consists of a steel containing 0.9 mass % to 1.1 mass % of carbon;

0.15 mass % to 0.25 mass % of silicon;

0.25 mass % to 0.35 mass % of manganese; and 0.15 mass % to 0.25 mass % of chromium, with the balance being Fe and incidental impurities, the steel including a pearlite structure, wherein the steel wire has a diameter of 0.05 mm to 0.45 mm, the steel wire has a tensile strength of 3900 MPa to 4700 MPa, in a longitudinal cross section of the steel wire, a surface region extends from a surface of the steel wire to a depth corresponding to 10% of the diameter, and the surface region has a microstructure in which a total ratio A, which is a sum of a ratio $A_{100}$ of a <100>-oriented texture, a ratio $A_{110}$ of a <110>-oriented texture, and a ratio $A_{111}$ of a <111>-oriented texture, is 32% or less, the ratio $A_{100}$ is an area ratio of grains having a <100> orientation in a predetermined direction to all grains in an observation field of the surface region, the ratio $A_{110}$ is an area ratio of grains having a <110> orientation in a predetermined direction to all the grains in the observation field of the surface region, and the ratio $A_{111}$ is an area ratio of grains having a <111> orientation in a predetermined direction to all the grains in the observation field of the surface region.

BRIEF DESCRIPTION OF DRAWINGS

FIG. 1 is a cross-sectional view illustrating a longitudinal cross section of a steel wire according to an embodiment.

DETAILED DESCRIPTION

Description of Embodiments of Present Disclosure

First, embodiments of the present disclosure are enumerated and described.

(1) According to an embodiment of the present disclosure, a steel wire consists of a steel containing 0.9 mass % to 1.1 mass % of carbon;

0.15 mass % to 0.25 mass % of silicon;

0.25 mass % to 0.35 mass % of manganese; and 0.15 mass % to 0.25 mass % of chromium, with the balance being Fe and incidental impurities, the steel including a pearlite structure, wherein the steel wire has a diameter of 0.05 mm to 0.45 mm, the steel wire has a tensile strength of 3900 MPa to 4700 MPa, in a longitudinal cross section of the steel wire, a surface region extends from a surface of the steel wire to a depth corresponding to 10% of the diameter, and the surface region has a microstructure in which a total ratio A, which is a sum of a ratio $A_{100}$ of a <100>-oriented texture, a ratio $A_{110}$ of a <110>-oriented texture, and a ratio $A_{111}$ of a <111>-oriented texture, is 32% or less, the ratio $A_{100}$ is an area ratio of grains having a <100> orientation in a predetermined direction to all grains in an observation field of the surface region, the ratio $A_{110}$ is an area ratio of grains having a <110> orientation in a predetermined direction to all the grains in the observation field of the surface region, and the ratio $A_{111}$ is an area ratio of grains having a <111> orientation in a predetermined direction to all the grains in the observation field of the surface region.

In the steel wire of the present disclosure, the total ratio A of the above-mentioned textures is 32% or less, and, therefore, the number of grains that are oriented in a specific direction is small in the surface region. That is, the microstructure of the surface region is in a state in which crystal orientations are randomly distributed. Thus, in the steel wire, the surface region is easily deformable under bending and torsion. With the total ratio A being 32% or less, the steel wire has excellent toughness.

Since the steel wire of the present disclosure has a tensile strength of 3900 MPa or greater, the steel wire has high strength. Thus, the steel wire of the present disclosure has both high strength and high toughness.

Since the steel wire of the present disclosure has a diameter of 0.05 mm to 0.45 mm, the steel wire can have reduced weight while the necessary strength is ensured.

(2) The steel wire of (1) may be one in which, in the observation field of the surface region, a total orientation density B, which is a sum of an orientation density $B_{100}$ of {100} planes and an orientation density $B_{111}$ of {111} planes, is 8.00 to 9.70.

When the total orientation density B is 8.00 to 9.70, the steel wire has both high strength and high toughness. The total orientation density B is the sum of the orientation density $B_{100}$ and the orientation density $B_{111}$.

(3) The steel wire of (1) or (2) may be one in which the total ratio A is 29% or less.

With the configuration of (3), toughness is further improved.

(4) The steel wire of (2) may be one in which the total orientation density B is 8.40 to 9.00.

With the configuration of (4), high strength and high toughness are both achieved.

(5) The steel wire of any one of (1) to (4) may be one in which the diameter of the steel wire is 0.15 mm to 0.42 mm.

With the configuration of (5), the strength and a reduction in weight can both be easily achieved.

(6) The steel wire of (5) may be one in which the diameter of the steel wire is 0.18 mm to 0.30 mm.

With the configuration of (6), the strength and a reduction in weight can both be easily achieved.

(7) The steel wire of any one of (1) to (6) may be one in which the tensile strength of the steel wire is 3960 MPa to 4500 MPa.

With the configuration of (7), a higher strength is achieved.

(8) According to an embodiment of the present disclosure, a method of manufacturing a steel wire includes providing a material consisting of a steel, the steel containing 0.9 mass % to 1.1 mass % of carbon, 0.15 mass % to 0.25 mass % of silicon, 0.25 mass % to 0.35 mass % of manganese, and 0.15 mass % to 0.25 mass % of chromium, with the balance being Fe and incidental impurities;

subjecting the material to a first drawing process;

subjecting a first wire rod, which results from the first drawing process, to a patenting process;

subjecting the first wire rod processed by the patenting process to a second drawing process; and subjecting a second wire rod, which results from the second drawing process, to skin pass drawing.

In the method of manufacturing a steel wire of the present disclosure, skin pass drawing is performed after a drawing process is performed, and, consequently, an orientation property of the grains in the surface region of the steel wire can be controlled. Specifically, the skin pass drawing allows the surface region to be in a state in which crystal orientations are in random directions, which results in a reduction in the ratio of the textures in the surface region. As a result, a steel wire having both high strength and high toughness can be obtained.

(9) The method of manufacturing a steel wire of (8) may be one in which, regarding the skin pass drawing, the second wire rod is subjected to the skin pass drawing one to eight times.

With the configuration of (9), the ratio of the textures in the surface region can be sufficiently reduced.

(10) The method of manufacturing the steel wire of (8) or (9) may be one in which a reduction ratio per pass of the skin pass drawing is 1.0% to 6.0%.

With the configuration of (10), the ratio of the textures in the surface region can be sufficiently reduced.

Details of Embodiments of Present Disclosure

Specific examples of the steel wire according to an embodiment of the present disclosure will be described.

Note that the present disclosure is not limited to the examples and is indicated by the claims and that all modifications within the meaning and scope of the claims and equivalents thereof are intended to be included herein.

<Steel Wire>

A feature of the steel wire of the present embodiment is that a surface region has a specific microstructure in a longitudinal cross section. Referring to FIG. 1, a steel wire 1 will be described using a 3D Cartesian coordinate system. The longitudinal cross section of the steel wire 1 is a cross section parallel to the Y-axis and passing through a center of the steel wire 1. The surface region 10 is a region extending from a surface of the steel wire 1 to a depth corresponding to 10% of a diameter of the steel wire 1. The depth is a distance from the surface of the steel wire 1 toward a center of the steel wire 1. In the steel wire 1 of the present embodiment, since the surface region 10 has a specific microstructure, the number of grains that are oriented in a specific direction is small in the surface region 10, as will be described later. That is, the microstructure of the surface region 10 is in a state in which crystal orientations are randomly distributed. As a result, the steel wire 1 of the present embodiment has improved torsional properties despite its high strength.

Referring to FIG. 1, the Y-axis is parallel to a longitudinal axis of the steel wire 1. The X-axis and the Z-axis are each orthogonal to the Y-axis.

(Composition)

The steel wire 1 consists of a steel containing 0.9 mass % to 1.1 mass % of carbon (C), 0.15 mass % to 0.25 mass % of silicon (Si), 0.25 mass % to 0.35 mass % of manganese (Mn), and 0.15 mass % to 0.25 mass % of chromium (Cr), with the balance being Fe and incidental impurities.

<Carbon (C)>

The steel wire 1 contains C in an amount of 0.9 mass % to 1.1 mass %. C is an element that enhances the strength of the steel wire 1. As the content of C increases, the strength of the steel wire 1 is improved further. On the other hand, if C is present in an excessive amount, the toughness of the steel wire 1 is reduced. The content of C may be, for example, 1.00 mass % to 1.05 mass %.

<Silicon (Si)>

The steel wire 1 contains Si in an amount of 0.15 mass % to 0.25 mass %. Si is an element effective for the deoxidization of steel. Furthermore, Si has an effect of enhancing the strength of the steel wire 1 by dissolving into ferrite of a pearlite structure. If Si is present in an excessive amount, the toughness of the steel wire 1 is reduced. The content of Si may be, for example, 0.20 mass % to 0.25 mass % or 0.20 mass % to 0.23 mass %.

<Manganese (Mn)>

The steel wire 1 contains Mn in an amount of 0.25 mass % to 0.35 mass %. Mn is an element effective for the deoxidization of steel. Furthermore, Mn has an effect of enhancing the strength of the steel wire 1 by improving the hardenability of the steel. If Mn is present in an excessive amount, the toughness of the steel wire 1 is reduced. The content of Mn may be, for example, 0.27 mass % to 0.33 mass % or be 0.30 mass %.

<Chromium (Cr)>

The steel wire 1 contains Cr in an amount of 0.15 mass % to 0.25 mass %. Cr has an effect of enhancing the strength of the steel wire 1 by reducing a lamellar spacing of the pearlite structure. If Cr is present in an excessive amount, it becomes difficult for pearlite transformation to occur. The content of Cr may be, for example, 0.20 mass % to 0.25 mass % or 0.20 mass % to 0.21 mass %.

<Incidental Impurities>

The steel wire 1 may contain incidental impurities. Examples of the incidental impurities include phosphorus (P), sulfur (S), and copper (Cu). Preferably, the contents of P and S are each 0.025 mass % or less.

The composition of the steel wire 1 can be determined, for example, by inductively coupled plasma optical emission spectrometry (ICP emission spectrometry).

(Shape)

The steel wire 1 may have a shape appropriately selected. The steel wire 1 of the present embodiment is a round wire having a circular transverse cross section. The transverse cross section of the steel wire 1 is a cross section orthogonal to the Y-axis. The transverse cross section of the steel wire 1 may have a non-circular shape. The non-circular shape is, for example, a polygonal shape or an elliptical shape. The polygonal shape is, for example, a rectangular shape or a hexagonal shape. The rectangular shape includes a square shape.

(Diameter)

The steel wire 1 has a diameter of 0.05 mm to 0.45 mm. The diameter of the steel wire 1 is a diameter of a circle having an area equal to the area of the transverse cross section of the steel wire 1. Since the steel wire 1 has a diameter in the above-mentioned range, the steel wire 1 can be suitably used as a reinforcing member for tires and the like. The diameter of the steel wire 1 may be 0.15 mm to 0.42 mm or 0.18 mm to 0.30 mm.

(Tensile Strength)

The steel wire 1 has a tensile strength of 3900 MPa to 4700 MPa. Since the steel wire 1 has such a tensile strength, the steel wire 1 has high strength and can be suitably used as a reinforcing member for tires and the like. The tensile strength of the steel wire 1 is the maximum stress reached when the steel wire 1 is pulled on a tensile tester at a specified speed until the steel wire 1 breaks. For example, a 200 mm test specimen cut from the steel wire 1 may be pulled at a crosshead speed of 100 mm/min until the test specimen breaks, to measure the tensile strength. The tensile strength of the steel wire 1 may be 3900 MPa to 4400 MPa.

(Microstructure)

The microstructure of the steel wire 1 is composed primarily of the pearlite structure. Since the steel wire 1 consists of a steel having the above-described composition and including a pearlite structure, the steel wire 1 can both have high strength and high toughness.

In general, steel wires are manufactured by a drawing process. Steel wires that have undergone a drawing process have a microstructure in which grains are stretched in the drawing direction and thus form a texture in which the grains are strongly oriented in a length direction of the steel wire. Steel wires having such a texture are unlikely to deform when, for example, they are bent or twisted. For example, when the steel wire is twisted, the steel wire cannot follow the torsional deformation, which is likely to result in breakage of the steel wire and the occurrence of delamination in the steel wire.

<Surface Region>

(Total Ratio of Textures)

The steel wire 1 of the present embodiment has, in the surface region 10, a microstructure in which crystal orientations are in random directions, with the ratio of textures that have specific crystal planes oriented in a specific direction being low. The surface region 10 is a region extending from a surface of the steel wire 1 to a depth corresponding to 10% of a diameter of the steel wire 1. The surface region 10 may be a region extending from the surface of the steel wire 1 to a depth of 5 μm to 20 μm.

The microstructure of the surface region 10 is one in which a total ratio A, which is the sum of a ratio $A_{100}$ of a <100>-oriented texture, a ratio $A_{110}$ of a <110>-oriented texture, and a ratio $A_{111}$ of a <111>-oriented texture, is 32% or less in the longitudinal cross section. That is, in the microstructure of the surface region 10, the ratio of the remaining portion, other than the above-mentioned textures, is 68% or more. In the <100>-oriented texture, grains have a <100> orientation in a predetermined direction. The ratio $A_{100}$ is an area ratio of grains having a <100> orientation in a predetermined direction to all grains in an observation field 30 of the surface region 10. In the <110>-oriented texture, grains have a <110> orientation in a predetermined direction. The ratio $A_{110}$ is an area ratio of grains having a <110> orientation in a predetermined direction to all the grains in the observation field 30 of the surface region 10. In the <111>-oriented texture, grains have a <111> orientation in a predetermined direction. The ratio $A_{111}$ is an area ratio of grains having a <111> orientation in a predetermined direction to all the grains in the observation field 30 of the surface region 10.

The "grains having a <100> orientation in a predetermined direction" are grains having a <100> orientation that is at an angle of 100 or less relative to the X-axis or the Z-axis, in the longitudinal cross section. The "grains having a <110> orientation in a predetermined direction" are grains having a <110> orientation that is at an angle of 100 or less relative to the X-axis or the Z-axis, in the longitudinal cross section. The "grains having a <111> orientation in a predetermined direction" are grains having a <111> orientation that is at an angle of 100 or less relative to the X-axis or the Z-axis.

The lower the total ratio A, the higher the degree of the state in which the crystal orientations are in random directions, and, therefore, the easier it is for the surface region to deform under bending and torsion. Since the total ratio A is 32% or less, the steel wire 1 has excellent torsional properties. Furthermore, the total ratio A may be 31% or less, 30% or less, or 29% or less. In such cases, the torsional properties are further improved. The lower limit of the total ratio A is, for example, 20%. The total ratio A is, for example, 20% to 32%, 20% to 31%, 20% to 30%, or 20% to 29%. The ratio $A_{100}$, the ratio $A_{110}$, the ratio $A_{111}$ are each, for example, 4% to 20% or 5% to 18%.

The respective ratios of the above-mentioned textures can be determined by electron backscatter diffraction (EBSD). Specifically, each of the ratios is determined as follows: the surface region 10 is observed in the longitudinal cross section of the steel wire 1, illustrated in FIG. 1, with a field emission scanning electron microscope (FE-SEM), and the crystal orientations of the surface region 10 are analyzed by EBSD. For example, the ratio $A_{100}$ is determined as follows. The orientations of all the grains present in the observation field 30 of the surface region 10 are determined. The orientations of the grains are orientations with respect to the directions of the X-axis and the Z-axis. The area ratio of grains having a <100> orientation that is at an angle of 100 or less relative to the X-axis or the Z-axis to all the grains is determined. The area ratio of grains having a <100> orientation that is at an angle of 100 or less relative to the X-axis and the area ratio of grains having a <100> orientation that is at an angle of 100 or less relative to the Z-axis are averaged, and the average is used as the ratio $A_{100}$. The ratio $A_{110}$ and the ratio $A_{111}$ can also be determined in the same manner as that for the ratio $A_{100}$. In the present disclosure, the area ratios of grains having a <111> orientation, a <110> orientation, or a <100> orientation that is at an angle of 10° or less in the observation field 30, which can be at any location for EBSD, can be any value that is 32% or less of the total area of the observation field 30.

The observation field 30 may be at any selected location in the surface region 10. The observation field 30 has a size including, for example, a length along the Y-axis of 50 μm to 150 μm and a length along the X-axis of 5 μm to 30 μm. The length along the Y-axis may be 100 μm, and the length along the X-axis may be 20 μm. The magnification for the observation may be appropriately selected in accordance with a size of the grains. The magnification for the observation may be, for example, 9000× or more. The observation field 30 may be made up of multiple observation fields connected together. Preferably, the longitudinal cross section of the steel wire 1 is a polished cross section. The longitudinal cross section may be a cross section resulting from, for example, processing with a cross section polisher.

(Orientation Density)

In the microstructure of the surface region 10, a total orientation density B, which is the sum of an orientation density $B_{100}$ of {100} planes and an orientation density $B_{111}$ of {111} planes, may be, for example, 8.00 to 9.70 in the longitudinal cross section. When the total orientation density B is 8.00 to 9.70, high torsional properties and high tensile strength can both be achieved. The total orientation density B may be 8.10 to 9.60 or 8.40 to 9.00. The orientation density $B_{100}$ and the orientation density $B_{111}$ are each, for example, 4.00 to 5.50.

The orientation density $B_{100}$ and the orientation density $B_{111}$ can be determined from a pole figure of the {100} plane and a pole figure of the {111} plane. A pole figure is a stereographically projected diagram representing the distribution of crystal orientations of a crystal plane of interest. In the pole figure, the distribution of crystal orientations is represented by a ratio of the number of grains having the crystal orientation of the crystal plane of interest in the observation field to the number of grains in a sample in which crystal orientations are randomly distributed. That is, the pole figure is an indicator representing an orientation density of a crystal orientation relative to that of a random microstructure. An orientation density of 1 indicates that the microstructure is equivalent to a random microstructure. Orientation densities of greater than 1 indicate that a greater number of grains are aligned along the crystal orientation than in a random microstructure. When the orientation densities are expressed as contours based on a distribution of the orientation densities determined from a pole figure, multiple local maximum points having different heights appear in the pole figure. The sample mentioned above does not have a specific orientation property. The sample mentioned above can be obtained, for example, by heat-treating the steel wire at a high temperature. The ratios of grains having the respective orientations <100>, <110>, and <111> to those of an ideal randomly oriented sample can be determined by calculation. The orientation density in the pole figure is the ratio relative to the calculated value.

Specifically, the orientation density $B_{100}$ and the orientation density $B_{111}$ are defined as follows. The orientation density $B_{100}$ is the maximum of all local maximum points in a pole figure of the {100} plane. The orientation density $B_{111}$ is the maximum of all local maximum points in a pole figure of the {111} plane.

(Uses)

The steel wire 1 of the present embodiment can be suitably used as a reinforcing member that is embedded in a rubber product, such as a tire. Examples of rubber products other than tires include conveyor belts, handrails of escalators, and hoses. Since the steel wire 1 of the present embodiment has high tensile strength, a strength can be ensured even if the steel wire 1 is thin, and, consequently, a reduction in the weight of rubber products can be achieved. The steel wire 1 of the present embodiment has high torsional properties, and, therefore, when the steel wire 1 is subjected to a twisting process, the steel wire 1 is unlikely to break and unlikely to experience delamination. Furthermore, even if twisting occurs in the steel wire 1 during the use of the rubber product, the steel wire 1 is unlikely to break and unlikely to experience delamination.

<Method of Manufacturing Steel Wire>

The steel wire 1 according to the embodiment can be manufactured by a method, according to an embodiment, of manufacturing a steel wire. According to the embodiment, the method of manufacturing a steel wire includes a first step, a second step, a third step, a fourth step, and a fifth step. Each of the steps will be described in detail below.

(First Step)

The first step is a step of providing a material consisting of a steel. The steel has a composition containing 0.9 mass % to 1.1 mass % of carbon, 0.15 mass % to 0.25 mass % of silicon, 0.25 mass % to 0.35 mass % of manganese, and 0.15 mass % to 0.25 mass % of chromium, with the balance being Fe and incidental impurities. The composition of the material wire is the same as the composition of the steel wire that is manufactured. The material is manufactured by a method such as a continuous casting method or a continuous casting and drawing method. The material may be processed, for example, by hot drawing to have a predetermined diameter. The material may have a diameter of, for example, 4 mm to 6 mm. The material may have a shape in which, for example, a transverse cross section is circular and thus may be a round wire.

(Second Step)

The second step is a step of subjecting the material to a first drawing process. The first drawing process is performed one or more times in a die until the diameter of the material becomes a predetermined diameter. The first drawing process is performed, for example, in a wet state. A reduction ratio per pass of the first drawing process may be, for example, 10% to 20%. The reduction ratio per pass is a ratio determined as follows: regarding the passage of the material through a die, the difference between a cross-sectional area of the material before the passage through the die and the cross-sectional area of the material after the passage through the die is determined, and the difference is divided by the cross-sectional area of the material before the passage through the die. The second step gives a first wire rod that results from the first drawing process. The first wire rod has a diameter of, for example, 1 mm to 2.5 mm.

A total reduction ratio of the first drawing process is, for example, 70% to 90%. The total reduction ratio of the first drawing process is a ratio determined as follows: the difference between a cross-sectional area of the material before the first drawing process and the cross-sectional area of the first wire rod after the first drawing process is determined, and the difference is divided by the cross-sectional area of the material.

(Third Step)

The third step is a step of subjecting the first wire rod processed by the first drawing process to a patenting process. The patenting process is a heat treatment for forming a pearlite structure in the steel that constitutes the first wire rod. In the patenting process, the first wire rod is heated to form an austenite structure in the steel, and subsequently, the first wire rod is cooled to form a pearlite structure in the steel. Specifically, the patenting process is performed as follows. First, the first wire rod is heated to an austenitization temperature range, and in this state, the first wire rod is held for a predetermined time to austenitize the steel. The austenitization temperature range is a temperature range greater than or equal to the austenitization temperature, that is, a temperature range greater than or equal to the Acm temperature. The austenitization temperature range is, for example, 950° C. to 1000° C. The holding time associated with the austenitization temperature range is, for example, 5 seconds to 10 seconds. Next, the first wire rod that has been austenitized is rapidly cooled to a pearlite transformation temperature range and held for a predetermined time to pearlitize the steel. The pearlite transformation temperature range is a temperature range less than the austenitization temperature and greater than the temperature at which martensite transformation is initiated, that is, a temperature range greater than the Ms temperature. The pearlite transformation temperature range is, for example, 500° C. to 600° C. The holding time associated with the pearlite transformation temperature range is, for example, 3 seconds to 10 seconds. With this patenting process, a fine pearlite structure is formed in the steel. After being held in the pearlite transformation temperature range, the first wire rod is cooled to ambient temperature. In the process of austenitization, the first wire rod may be heated in an inert gas atmosphere to inhibit the occurrence of decarburization.

(Fourth Step)

The fourth step is a step of subjecting the first wire rod processed by the patenting process to a second drawing process. The second drawing process is performed one or more times in a die until the diameter of the first wire rod becomes a diameter close to the diameter of the steel wire that is manufactured. The conditions for the second drawing process are similar to the conditions for the first drawing process. The fourth step gives a second wire rod that results from the second drawing process. The diameter of the second wire rod is slightly smaller than the diameter of the steel wire. The diameter of the second wire rod is, for example, greater than 0.05 mm to 0.45 mm.

A total reduction ratio of the second drawing process, after the patenting process, is, for example, 95% to 99.5%. The total reduction ratio of the second drawing process is a ratio determined as follows: the difference between a cross-sectional area of the first wire rod before the second drawing process and the cross-sectional area of the second wire rod after the second drawing process is determined, and the difference is divided by the cross-sectional area of the first wire rod. Because of the total reduction ratio of the second drawing process of 95% or more, it is possible to obtain a high-strength steel wire having a tensile strength of 3900 MPa or more.

(Fifth Step)

The fifth step is a step of subjecting the second wire rod that results from the second drawing process to skin pass drawing. The skin pass drawing is a drawing process performed at a very low reduction ratio. The skin pass drawing can cause a change in the orientation property of the grains in the surface region of the steel wire. With this process, it is possible to obtain the steel wire 1 of the present embodiment, in which the surface region has a specific microstructure.

The skin pass drawing is performed one or more times in a die. The skin pass drawing may be performed in a wet state or a dry state. Preferably, the skin pass drawing is performed in a wet state. The skin pass drawing, which is performed one or more times, allows the steel wire to be in a state in which the crystal orientations in the surface region are in random directions, and, consequently, the total ratio A of the above-mentioned textures is reduced compared to instances in which skin pass drawing is not performed. The number of times that the skin pass drawing is performed may be, for example, one to eight times. The greater the number of times that the skin pass drawing is performed, the greater the degree to which the total ratio Ais reduced. When the number of times that the skin pass drawing is performed is eight times or less, the time required for the skin pass drawing can be shortened, which improves productivity. The number of times that the skin pass drawing is performed may alternatively be two to eight times or three to eight times.

A reduction ratio per pass of the skin pass drawing is, for example, 1.0% to 6.0%. The reduction ratio per pass is a ratio determined as follows: regarding the passage of the second wire rod through a die, the difference between a cross-sectional area of the second wire rod before the passage through the die and the cross-sectional area of the second wire rod after the passage through the die is determined, and the difference is divided by the cross-sectional area of the second wire rod before the passage through the die. Because of the reduction ratio per pass of the skin pass drawing of 1.0% to 6.0%, the steel wire can be easily placed in a state in which the crystal orientations in the surface region are in random directions, and, therefore, the total ratio A can be easily controlled to be 32% or less. The reduction ratio per pass of the skin pass drawing may alternatively be 1.5% to 5.5%, 1.5% to 5.0%, or 1.5% to 4.0%. A total reduction ratio of the skin pass drawing is, for example, 7.7% to 39.0%. The total reduction ratio of the skin pass drawing is a ratio determined as follows: the difference between a cross-sectional area of the second wire rod before the skin pass drawing and the cross-sectional area of the steel wire after the skin pass drawing is determined, and the difference is divided by the cross-sectional area of the second wire rod.

An approach angle of the die that is used in the skin pass drawing is, for example, 2° to 10°. When the approach angle is 2° to 10°, crystal orientations that are in random directions can be easily achieved in the surface region of the steel wire. In other cases, the approach angle is 3° to 8°.

The skin pass drawing may be performed directly after the second drawing process or may be performed after the second wire rod that results from the second drawing process is temporarily coiled.

Test Example 1

Steel wire samples were prepared. The prepared steel wire samples were evaluated.

(Preparation of Samples)

Steel wires of sample Nos. 1 to 15 were prepared in accordance with the above-described method of manufacturing a steel wire. In this instance, materials consisting of a steel having a composition A or a composition B, shown in Table 1, were provided. The content of each of the elements shown in Table 1 is a value based on the total content of the elements present in the steel taken as 100 mass %. In Table 1, "Bal." in the "Fe" column denotes the balance. The materials were manufactured by melting and casting steel and then hot-drawing the cast steel into a wire shape. The materials had a shape of a round wire. The materials had a diameter of 5.0 mm.

The materials were each subjected to the first drawing process to form a first wire rod. The first wire rod had a shape of a round wire. The first wire rod had a diameter of 1.4 mm. The first drawing process was performed in a wet state. The reduction ratio per pass of the first drawing process was set to be 10% to 30%. The number of times that the first drawing process was performed was 10.

The first wire rod that resulted from the first drawing process was subjected to the patenting process. In the patenting process, the first wire rod was heated to 980° C. in a heating furnace and held for 8 seconds, and then, the first wire rod was immediately placed in a cooling chamber to be cooled to 580° C. and was held for 10 seconds. Subsequently, the first wire rod was cooled to ambient temperature. The heating of the first wire rod was performed in an inert gas atmosphere.

The first wire rod processed by the patenting process was subjected to the second drawing process to form a second wire rod. The second wire rod had a shape of a round wire. The second wire rod had a diameter close to the diameter of the steel wire that would be produced. The second drawing process was performed in a wet state. The reduction ratio per pass of the second drawing process was set to be 10% to 20%. The number of times that the second drawing process was performed was 24. The total reduction ratio achieved during the time from the start of the first drawing process to the end of the second drawing process was 95% or more. The total number of times that the first drawing process and the second drawing process were performed was 20 or more.

The second wire rods that resulted from the second drawing process were subjected to skin pass drawing to form steel wires of sample Nos. 1 to 15. The steel wires had a shape of a round wire. The skin pass drawing was performed in a wet state. The die had an approach angle of 5°. The number of times that the skin pass drawing was performed and the reduction ratio per pass of the skin pass drawing are each shown in Table 2.

The diameter and the composition of the prepared steel wires of sample Nos. 1 to 15 are shown in Table 2. The compositions indicated in the "Composition" column in Table 2 are listed in Table 1.

The steel wires of sample Nos. 16 to 20 were manufactured in a manner similar to that for the steel wires of sample Nos. 1 to 15, except that skin pass drawing was not performed. The diameter and the composition of the steel wires of sample Nos. 16 to 20 are shown in Table 2. In Table 2, with regard to the steel wires of sample Nos. 16 to 20, which were not subjected to skin pass drawing, the "Number of Times" column indicates "0", and the "Reduction Ratio" column shows "-", regarding the skin pass drawing.

(Evaluations of Samples)

<Analysis of Microstructure>

Analysis was performed on the microstructure of the steel wire of each of the samples. Measurement specimens for the analysis were prepared from the steel wire of each of the samples. The measurement specimens had a length of 20 mm. The measurement specimens were each embedded in a resin, and subsequently, cross section processing was performed on the measurement specimen with a cross section polisher to expose a longitudinal cross section of the steel wire. For the cross section polisher, the following conditions were used: an acceleration voltage of 6 kV and a probe current of 130 μA. In a finishing process for the cross section, the acceleration voltage was 1 kV.

The longitudinal cross section of the measurement specimen was observed with an FE-SEM, and the microstructure of the surface region was analyzed. The FE-SEM used was a Gemini 450, manufactured by Zeiss. The conditions set for the observation were as follows: a magnification of 300×, an acceleration voltage of 15 kV, a probe current of 21 nA, and a working distance (WD) of 14.5 mm. The region to be observed was set to have a range from a surface of the steel wire to a depth of 20 μm. The observation field had a size including a length along the Y-axis of 100 μm and a length along the X-axis of 20 μm. The results of the analysis of the microstructure in the observation field confirmed that all samples had a pearlite structure.

<Analysis of Crystal Orientation>

The longitudinal cross section of each of the measurement specimens was observed with an FE-SEM, and the crystal orientations in the surface region were analyzed with an EBSD included in the FE-SEM. The EBSD used was a Symmetry, manufactured by Oxford Instruments. The conditions set for the observation were an acceleration voltage of 15 kV and a probe current of 10 nA. The conditions set for the EBSD were as follows: an integration time of 0.3 milliseconds, a binning of 4×4, a working distance (WD) of 15 mm, a step size of 0.04 μm, and a tilt angle of 70°. The sizes of the region observed and the observation field were the same as those of the range of the microstructure analysis.

(Total Ratio of Textures)

In the observation field, the ratio $A_{100}$ of a <100>-oriented texture, the ratio $A_{110}$ of a <110>-oriented texture, and the ratio $A_{111}$ of a <111>-oriented texture were each determined using analysis software. Then, the total ratio A, which is the sum of the ratio $A_{100}$, the ratio $A_{110}$, and the ratio $A_{111}$, was determined. The results are shown in Table 2.

(Orientation Density) Furthermore, a pole figure of the {100} plane and a pole figure of the {111} plane were acquired using analysis software. The orientation density $B_{100}$ of {100} planes and the orientation density $B_{111}$ of {111} planes were determined from the respective pole figures. Then, the total orientation density B, which is the sum of the orientation density $B_{100}$ and the orientation density Bill, was determined. The results are shown in Table 2.

<Tensile Strength>

The tensile strength of the steel wire of each of the samples was measured. Test specimens for a tensile test were prepared by cutting the steel wires. The test specimens had a length of 200 mm. The test specimens were each pulled on a tensile tester at a crosshead speed of 100 mm/min until the test specimen broke, to measure the tensile strength. The results are shown in Table 2.

<Torsional Properties>

Torsional properties of the steel wire of each of the samples were evaluated. Test specimens for a torsion test were prepared by cutting the steel wires. The test specimens had a length that was 100 times the diameter, that is, the diameter×100 mm. The test specimens were each twisted in one direction on an electric torsion tester in a state in which tension was being applied to the test specimen, until the test specimen broke, to measure the number of times that torsion was applied. To count the number of times that torsion was applied, one rotation was regarded as one time. The number of times that torsion is applied is referred to as a torsion value. A torsion rate was 30 rpm. The torsion rate is the number of rotations per minute. The tension was set to be 5% or less of a yield stress of the steel wire. The yield stress of the steel wire can be determined by a tensile test. The torsion value of each of the samples is shown in Table 2. Furthermore, the number of times that torsion was applied at delamination occurred was measured. If delamination occurs during a torsion test, the torque applied by the torsion tester decreases. By measuring the torque, it is possible to determine whether delamination occurred. Regarding each of the samples, the number of times that torsion was applied at delamination occurred is indicated in the "Number of Times at Delamination Occurrence" column in Table 2. In instances where breakage occurred without the occurrence of delamination, "-" is shown in the "Number of Times at Delamination Occurrence" column.

TABLE 1

| | Element (mass %) | | | | |
|---|---|---|---|---|---|
| Composition | C | Si | Mn | Cr | Fe |
| A | 1.05 | 0.20 | 0.30 | 0.20 | Bal. |
| B | 1.00 | 0.23 | 0.30 | 0.21 | Bal. |

nation occurrence was 3 or less, which indicates that delamination occurred at an early stage. Furthermore, in the case of all these steel wires, the maximum torsion value was only 18. The torsional properties of the steel wires of sample Nos. 16 to 20 were poor. In all of the steel wires of sample Nos. 16 to 20, the total ratio A was 33% or more. In addition, in these steel wires, the total orientation density B also fell out of the range of 8.00 to 9.70.

Thus, it is apparent that the steel wires having a specific microstructure in the surface region have both high strength and high toughness. It is also apparent that such steel wires can be obtained by performing skin pass drawing after the final drawing process.

A further observation made from the results of Test Example 1 is as follows. When steel wire samples having the same diameter and the same composition are compared with one another, the greater the number of times that the skin

TABLE 2

| | Steel Wire | | | Skin Pass Rolling | | Surface Region | | Torsional Properties | |
|---|---|---|---|---|---|---|---|---|---|
| No. | Diameter (mm) | Composition | Tensile Strength (Mpa) | Number of Times (number) | Reduction Ratio (%) | Total Ratio A (%) | Total Orientation Density B | Torsion Value (number) | Number of Times at Delamination Occurrence (number) |
| 1 | 0.186 | B | 4302 | 5 | 1.5 | 29 | 9.1 | 24 | — |
| 2 | 0.186 | B | 4305 | 8 | 1.5 | 26 | 9.6 | 26 | — |
| 3 | 0.198 | B | 4248 | 5 | 2.4 | 31 | 9.0 | 24 | — |
| 4 | 0.198 | B | 4233 | 8 | 2.4 | 30 | 9.0 | 25 | — |
| 5 | 0.208 | B | 4235 | 1 | 3.7 | 32 | 9.0 | 20 | — |
| 6 | 0.208 | B | 4213 | 3 | 3.7 | 30 | 8.4 | 22 | — |
| 7 | 0.208 | B | 4183 | 5 | 3.7 | 28 | 8.8 | 23 | — |
| 8 | 0.212 | A | 4277 | 1 | 5.4 | 31 | 8.1 | 15 | — |
| 9 | 0.212 | A | 4126 | 1 | 3.7 | 29 | 8.4 | 22 | — |
| 10 | 0.212 | A | 4067 | 3 | 5.4 | 30 | 8.8 | 17 | — |
| 11 | 0.212 | A | 4070 | 3 | 3.7 | 26 | 8.9 | 23 | — |
| 12 | 0.295 | B | 3972 | 1 | 2.7 | 31 | 8.4 | 23 | — |
| 13 | 0.295 | B | 3901 | 1 | 4.0 | 32 | 8.3 | 21 | — |
| 14 | 0.295 | B | 3913 | 3 | 2.7 | 28 | 9.1 | 25 | — |
| 15 | 0.295 | B | 3969 | 3 | 4.0 | 30 | 9.0 | 22 | — |
| 16 | 0.186 | B | 4334 | 0 | — | 35 | 7.8 | 16 | 2 |
| 17 | 0.198 | B | 4257 | 0 | — | 33 | 7.6 | 15 | 3 |
| 18 | 0.208 | B | 4227 | 0 | — | 36 | 7.7 | 16 | 2 |
| 19 | 0.211 | A | 4141 | 0 | — | 34 | 9.8 | 16 | 2 |
| 20 | 0.295 | B | 3965 | 0 | — | 37 | 9.9 | 18 | 1 |

As shown in Table 2, the steel wires of sample Nos. 1 to 15, which underwent skin pass drawing one or more times, had a torsion value of 15 or more and did not experience delamination before the steel wires broke. Thus, the steel wires of sample Nos. 1 to 15 had high torsional properties. All of the steel wires of sample Nos. 1 to 15 except for the steel wires of samples Nos. 8 and 10 had a torsion value of 20 or more and thus had even higher torsional properties. Furthermore, the steel wires of sample Nos. 1 to 15 had a tensile strength of 3900 MPa or more and thus had high tensile strength, too. The steel wires of sample Nos. 1 to 15 had excellent torsional properties despite their high strength.

The steel wires of sample Nos. 1 to 15 all had a specific microstructure in the surface region. Specifically, in these steel wires, the total ratio A was 32% or less. In addition, in these steel wires, the total orientation density B also satisfied the range of 8.00 to 9.70.

In contrast, the steel wires of sample Nos. 16 to 20, which did not undergo skin pass drawing, had a torsion value of 15 or more but experienced delamination before the steel wires broke. In these steel wires, the number of times at delamipass drawing was performed, the higher the tendency for the total ratio A to be reduced, provided that the reduction ratios for the skin pass drawing are the same. This can be confirmed, for example, by a comparison between samples Nos. 5, 6, and 7. Furthermore, it can be assumed, from a comparison between samples Nos. 8 and 9 and a comparison between samples Nos. 10 and 11, that when the reduction ratio for the skin pass drawing is 5% or less, the total ratio A can be further reduced.

REFERENCE SIGNS LIST

1 steel wire
10 surface region
30 observation field

The invention claimed is:

1. A steel wire consisting of a steel containing:
0.9 mass % to 1.1 mass % of carbon;
0.15 mass % to 0.25 mass % of silicon;
0.25 mass % to 0.35 mass % of manganese;
0.15 mass % to 0.25 mass % of chromium; and a balance being Fe and incidental impurities, wherein the steel wire includes a pearlite structure, wherein the steel wire has a diameter of 0.05 mm to 0.45 mm, wherein the steel wire has a tensile strength of 3900 MPa to 4700 MPa, wherein the steel wire is analyzed in a longitudinal cross section that is parallel to a Y-axis and passes through a center of the steel wire, the Y-axis being parallel to a longitudinal axis of the steel wire, and an X-axis and a Z-axis each being orthogonal to the Y-axis, wherein the steel wire has a surface region extending from a surface of the steel wire to a depth corresponding to 10% of the diameter of the steel wire, wherein, in an observation field of the surface region having a length of 100 μm along the Y-axis and a length of 20 μm along the X-axis, crystal orientations of grains are analyzed by electron backscatter diffraction, wherein a ratio $A_{100}$ is an average of:

(i) an area ratio of grains having a <100> orientation at an angle of 10° or less relative to the X-axis to all grains in the observation field, and (ii) an area ratio of grains having a <100> orientation at an angle of 10° or less relative to the Z-axis to all grains in the observation field, wherein a ratio $A_{110}$ is an average of:

(i) an area ratio of grains having a <110> orientation at an angle of 10° or less relative to the X-axis to all grains in the observation field, and (ii) an area ratio of grains having a <110> orientation at an angle of 10° or less relative to the Z-axis to all grains in the observation field, wherein a ratio $A_{111}$ is an average of:

(i) an area ratio of grains having a <111> orientation at an angle of 10° or less relative to the X-axis to all grains in the observation field, and (ii) an area ratio of grains having a <111> orientation at an angle of 10° or less relative to the Z-axis to all grains in the observation field, wherein a total ratio A, defined as $A_{100}+A_{110}+A_{111}$, is 29% or less, wherein a total orientation density B, defined as $B_{100}+B_{111}$, is 8.40 to 9.00, wherein $B_{100}$ is a maximum value among local maximum points in a pole figure of {100} planes determined from the observation field, and wherein $B_{111}$ is a maximum value among local maximum points in a pole figure of {111} planes determined from the observation field.

2. The steel wire according to claim 1, wherein the carbon content is 1.00 mass % to 1.05 mass %.

3. The steel wire according to claim 1, wherein the silicon content is 0.20 mass % to 0.25 mass %.

4. The steel wire according to claim 1, wherein the manganese content is 0.27 mass % to 0.33 mass %.

5. The steel wire according to claim 1, wherein the diameter of the steel wire is 0.18 mm to 0.30 mm.

6. The steel wire according to claim 1, wherein the tensile strength of the steel wire is 3960 MPa to 4500 MPa.

7. The steel wire according to claim 1, wherein the chromium content is 0.20 mass % to 0.25 mass %.

8. The steel wire according to claim 1, wherein each of the ratio $A_{100}$, the ratio $A_{110}$, and the ratio $A_{111}$ is 5% to 18%.

9. The steel wire according to claim 1, wherein each of the orientation density $B_{100}$ and the orientation density $B_{111}$ is 4.00 to 5.50.

10. A method of manufacturing the steel wire according to claim 1, the method comprising:

providing a steel material consisting of:

0.9 mass % to 1.1 mass % of carbon;

0.15 mass % to 0.25 mass % of silicon;

0.25 mass % to 0.35 mass % of manganese;

0.15 mass % to 0.25 mass % of chromium; and a balance being Fe and incidental impurities;

performing a first drawing process;

on the steel material to obtain a first wire rod;

performing a patenting process;

on the first wire rod to obtain a second wire rod;

performing a second drawing process on the second wire rod to obtain a third wire rod; and performing a skin pass drawing process on the third wire rod to obtain the steel wire, wherein the skin pass drawing process is performed such that the steel wire has:

a diameter of 0.05 mm to 0.45 mm;

a tensile strength of 3900 MPa to 4700 MPa;

a total ratio A of 29% or less; and a total orientation density B of 8.40 to 9.00, wherein the total ratio A and the total orientation density B are determined according to claim 1.

11. The method according to claim 10, wherein the skin pass drawing process includes performing skin pass drawing 1 to 8 times.

12. The method according to claim 10, wherein the skin pass drawing process includes reducing a diameter of the third wire rod at a reduction ratio of 1.0% to 6.0% per skin pass.

* * * * *